United States Patent [19]

Yanagawa et al.

[11] 4,291,843

[45] Sep. 29, 1981

[54] WEB WINDING APPARATUS

[75] Inventors: Hitoshi Yanagawa, Tokyo; Motofumi Konishi, Yokohama; Yoshio Ando, Chigasaki; Kazuo Kashiwagi, Tokyo, all of Japan

[73] Assignee: Canon Kabushiki Kaisha, Tokyo, Japan

[21] Appl. No.: 55,594

[22] Filed: Jul. 9, 1979

[30] Foreign Application Priority Data

Jul. 13, 1978 [JP] Japan ..... 53-85745

[51] Int. Cl.[3] ..... B65H 25/32

[52] U.S. Cl. ..... 242/57; 242/188

[58] Field of Search ..... 242/57, 67.1 R, 67.3 R, 242/67.5, 75.51, 75.52, 186, 188, 195; 318/6, 7, 461–465

[56] References Cited

U.S. PATENT DOCUMENTS

| | | | |
|---|---|---|---|
| 3,473,042 | 10/1969 | Orlando | 242/186 |
| 3,732,477 | 5/1973 | Cicatelli | 242/57 X |
| 3,826,447 | 7/1974 | Yabu et al. | 242/188 |
| 3,915,407 | 10/1975 | Zavdowicz | 242/188 |

*Primary Examiner*—John M. Jillions

*Attorney, Agent, or Firm*—Fitzpatrick, Cella, Harper & Scinto

[57] ABSTRACT

A web winding apparatus for automatically winding a web, wherein a winding shaft is driven by a driving device, said winding shaft being adapted, in response to the rotation thereof, to generate pulse signals of which interval is detected to identify whether the web is correctly wound on said winding shaft. In case the web is not correctly wound on the winding shaft, it is cut off from the driving device to prevent damage or breakage of the web.

12 Claims, 7 Drawing Figures

WEB WINDING APPARATUS

BACKGROUND OF THE INVENTION

1. Field of the Invention

The present invention relates to a winding apparatus for winding a continuous web such as a microfilm.

2. Description of the Prior Art

In recent years, the microfilms are increasingly utilized for the purpose of reduction recording of ever increasing publications and documents and are utilized in combination with known microfilm handling systems such as microfilm reader, microfilm reader-printer or microfilm retriever for the retrieval of the desired information and for the projection on a screen or the printing of thus retrieved information. The microfilms are available in the form of a continuous rolled film, a microfiche or in other forms, and the microfilm in the continuous form is generally wound as a roll on a reel or in a cartridge. In a microfilm apparatus such rolled microfilm is advanced from a feed section through a retrieval section or a projection section to a winding section for take-up on a winding shaft or reversed from said winding section to the feed section, and the retrieval or projection of a desired image frame is achieved during the advancement or reverse advancement of the microfilm. In such microfilm apparatus there is generally employed an automatic loading system for feeding the microfilm from the feed section to the winding section, wherein the microfilm is automatically drawn, in response to the actuation of an operating button, for example from a film cartridge fitted into said microfilm apparatus and advanced through a determined path for automatic take-up on a winding shaft in the winding section. Such apparatus is however generally associated with a drawback in that, in case the leading end of the microfilm is not securely wound on the winding shaft but is jammed in the film path, the microfilm is folded and superposed on itself, eventually leading to the damage or breakage of film. For this reason there is generally provided a microswitch along the film path for detecting the superposed state of the film caused by such jamming and interrupting the film advancement, but such method is insufficient for preventing the damage on the film because of the relatively slow detection of or the frequent failure in the film jamming.

The object of the present invention is to provide a web winding apparatus capable of preventing the abovementioned drawback and rapidly and securely detecting any abnormality in the web transportation resulting from the jamming, breakage etc. of the web thereby avoiding the damage on the web.

The present invention is applicable to various web-shaped materials such as microfilm, magnetic tape or 8-mm movie film.

DETAILED DESCRIPTION OF THE PREFERRED EMBODIMENTS

The present invention will be clarified in detail by the preferred embodiments thereof shown in the attached drawings.

Figure 1:
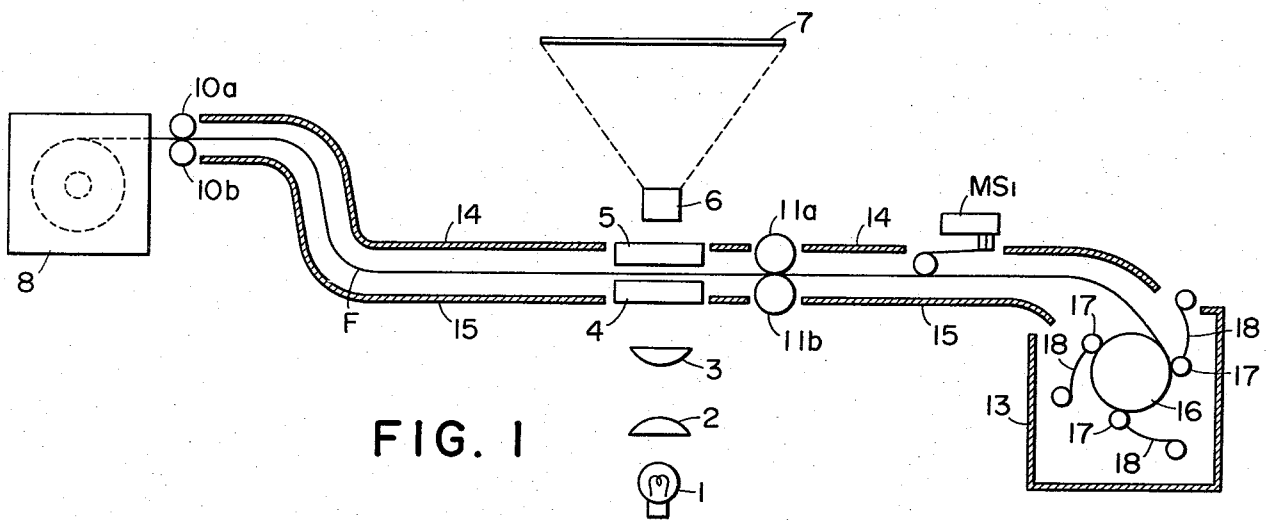
FIG. 1 is a schematic view of a microfilm reader embodying the present invention.

In FIG. 1 illustrating a microfilm reader embodying the winding apparatus of the present invention, there are shown an illuminating lamp 1 and condenser lenses 2 and 3 constituting illuminating means for illuminating a particular portion or frame of the microfilm, film pressure plates 4 and 5 composed of transparent glass plates and mutually separated during film transportation but brought into contact with the film when it is stopped to maintain said film in a planar focal position, said pressure plates being rendered displaceable by means for example of known plungers, a projection lens 6 for projecting an enlarged image of the microfilm, a horizontal screen 7 for observing thus projected image, a cartridge 8 housing a rolled continuous microfilm F and placed in a feed section, a first capstan roller 10*a*, a first pinch roller 10*b*, a second capstan roller 11*a*, a second pinch roller 11*b*, a winding case 13 placed in a film winding section, film guides 14 and 15, said first and second capstan rollers 10*a*, 11*a* being connected to film drive motors to be explained later to drive said microfilm F in the forward or reverse direction in cooperation with said pinch rollers 10*b*, 11*b*, a microswith MS1 for detecting the presence of said microfilm F, a rotatable winding shaft 16 for taking up said microfilm F, and three film pressure rollers 17 rotatably supported respectively by leaf springs 18 and resiliently pressed against the periphery of said winding shaft 16 and thereby guiding the leading end of the microfilm F along said periphery, thus automatically winding said leading end around said winding shaft 16 by means of the friction between said film and said rollers 17.

Figure 2:
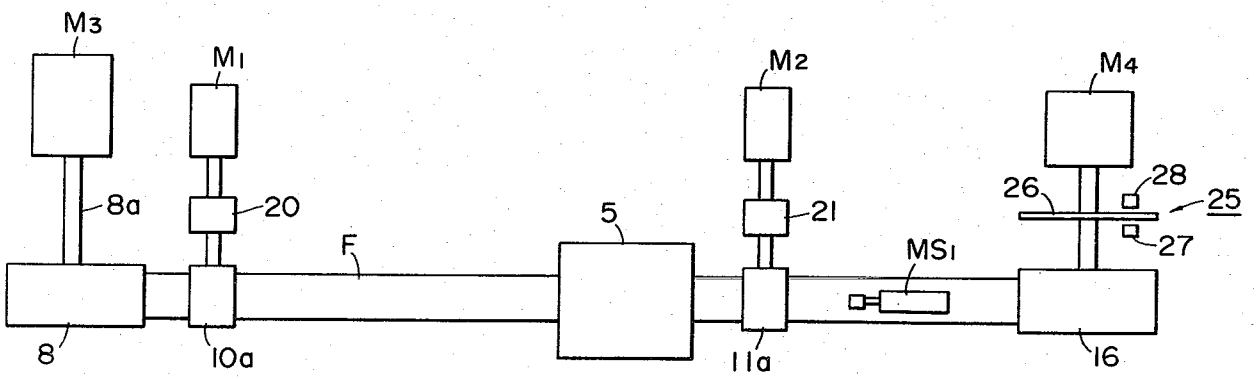
FIG. 2 is a schematic view of film drive mechanism.
Figure 3:
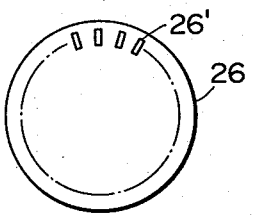
FIG. 3 is an elevation view of a disc.

FIG. 2 shows the film drive mechanism of said microfilm reader, wherein there are provided film drive motors M1 and M2 for forward or reverse rotation which are respectively connected through brake mechanisms 20, 21 to said first and second capstan rollers 10*a*, 11*a* whereby said capstan rollers are rendered rotatable and driven by said motors M1, M2 when said brake mechanisms 20, 21 are not in function to automatically advance the microfilm F from the cartridge 8 through the film guides 14, 15 and film pressure plates 4, 5 toward the film winding shaft 16, while such film advancement is interrupted when said brake mechanisms 20, 21 are energized to arrest the rotation of capstan rollers 10*a*, 11*a*. Also there are shown a film tensioning and rewinding motor M3 connected to the film winding shaft 8*a* of said cartridge 8 and adapted to be driven in a direction to rewind the film F into said cartridge 8, and a film tensioning and winding motor M4 connected to the winding shaft 16 and adapted to be driven in a direction to take up the film F on said winding shaft 16.

There is further shown a pulse generator 25 for generating electric pulse signals in response to the rotation of said winding shaft 16, said pulse generator 25 being composed of a disc 26 mounted on the winding shaft 16, a light source 27 consisting of a light-emitting diode and a photoelectric transducer 28 consisting of a phototransistor, said light source and photoelectric transducer being provided in mutually facing positions on both sides of said disc 26. Said disc 26 is provided along the periphery thereof with a plurality of equally distanced slits 26', whereby, upon rotation of said disc 26 integrally with the winding shaft 16 by the motor M4, the light from said light source 27 is intermittently received by said photoelectric transducer 28 to generate pulse signals of a determined width therefrom. Said motors M3 and M4 are designed to have a same torque which is smaller than that of the motors M1 and M2.

Thus, in the above-explained apparatus, when the film advancement is instructed by an operating button in a state wherein the leading end of the film F is drawn out from the cartridge 8 and pinched between the rollers 10*a* and 10*b*, the motors M1, M2 and M4 are put into motion whereby the film F is advanced along the determined path between the film guides 14, 15 to actuate the microswitch MS1 which thus detects the presence of the film F and activates the motor M3. Despite the activation of said motor M3, the winding shaft 8*a* of the cartridge 8 continues to rotate in the film forwarding direction as the film continues to be drawn out from the cartridge 8. On the other hand the winding shaft 16 initially performs an idle rotation at a high speed because of the absence of the film thereon. Upon arrival of the leading end of the film F between the winding shaft 16 and the film pressure rollers 17, the film is wound on said winding shaft 16 by means of the drive by the motor M4, thus eliminating the film slack in the path therefor and reducing the rotating speed of the shaft 16 to a value corresponding to the feeding speed of the film F.

In case the motors M1, M2 are put out of motion and the brake mechanisms 20, 21 are energized, the winding shaft 8*a* of the cartridge 8 and the winding shaft 16 are respectively biased in the rewinding and winding directions by means of the motors M3 and M4 but the film F remains still under a determined tension without slack between said two winding shafts since the torque of the motor M3 is equal to that of the motor M4.

From this state the film F can be taken up on the winding shaft 16 or rewound in the cartridge 8 by driving the motors M1, M2 respectively in the forward direction or in the reverse direction. It will also be understood that the motor M1 can be placed out of function once the presence of the film F is detected by the microswitch MS1.

In response to the rotation of said winding shaft 16, as explained in the foregoing, the pulse generator 25 generates pulse signals of which interval is constant when the rotating speed of the winding shaft 16 is constant, or becomes shorter or longer respectively when said rotating speed becomes higher or lower. Thus said interval of the pulse signals is short when the winding shaft 16 is performing idle rotation at a high speed without the film thereon, and becomes longer when the winding shaft 16 is rotated at a lower speed to wind the film thereon. In this manner the interval of the pulse signals varies in response to the rotating speed of the winding shaft 16, and it is therefore rendered possible to identify the take-up state of the film on said winding shaft by detecting said variation in the pulse interval.

Figure 4:
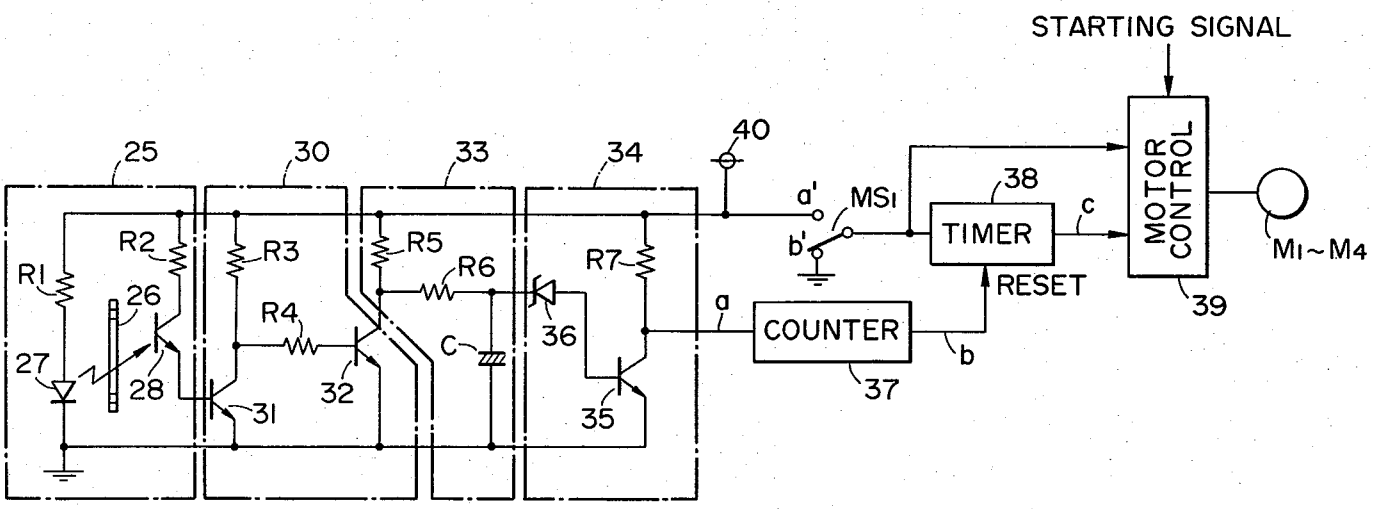
FIG. 4 is a circuit diagram for detecting abnormality in the film transportation.

FIG. 4 shows a circuit for detecting the abnormality in the film advancement, wherein there are shown the aforementioned pulse generator 25 composed of the light emitting diode 27, phototransistor 28 and resistors R1 and R2 to generate pulse signals from the emitter of said photo-transistor 28 in response to the rotation of the disc 26, an amplifier 30 composed of transistors 31, 32 and resistors R3, R4, a time constant circuit 33 composed of a condenser C and resistors R5, R6, a comparator circuit 34 composed of a transistor 35, a Zener diode 36 and a resistor R7 for comparing the interval of said pulse signals with the time constant of said time constant circuit 33, a power supply terminal 40, a counter 37, a timer 38 and a motor drive control circuit 39.

It is now assumed that the interval of the pulse signals generated from the pulse generator 25 is represented by t1 and t2 respectively when the winding shaft 16 is in idle rotation at a high speed or when said shaft 16 is rotated at a lower speed for film winding, and the time constant t3 of said time constant circuit is selected so as to satisfy the following relationship $t1<t3<t2$.

In case of the idle rotation of the winding shaft 16 at a high speed, since the interval t1 of the pulse signals from the pulse generator 25 is shorter than the time constant t3 of said time constant circuit 33, the collector of the transistor 35 is constantly maintained at a high potential whereby no signal is obtained on the output terminal *a* of the comparator circuit 34. On the other hand, when the rotating speed of the winding shaft 16 is reduced upon arrival of the film, the interval t2 of said pulse signals becomes longer than the time interval t3, whereby the collector of the transistor 35 shows change in the potential to release logic "0" from said output terminal *a* of the comparator circuit 34. Said count signals, generated when the film F is taken up on the winding shaft 16 and indicating the presence of a correct take-up state, are released corresponding to each interval of the pulse signals from the pulse generator 25 and counted by the counter 37, which, upon counting an arbitrarily selectable number of said count signals, releases a reset signal from an output terminal *b* to reset and inactivate the timer. In the following description, for the purpose of clarity, it is assumed that the reset signal is released upon counting of ten count signal by the counter 37. The microswitch MS1 closes the contact *a'* during the absence of the film F while it closes the contact *b'* upon detection of the present of the film F to activate the timer 38, of which functioning time is selected slightly longer than the time required from the film detection by the microswitch MS1 to the release of the reset signal from the counter 37 in case of a correct take-up of the film on the winding shaft 16.

Figure 5:
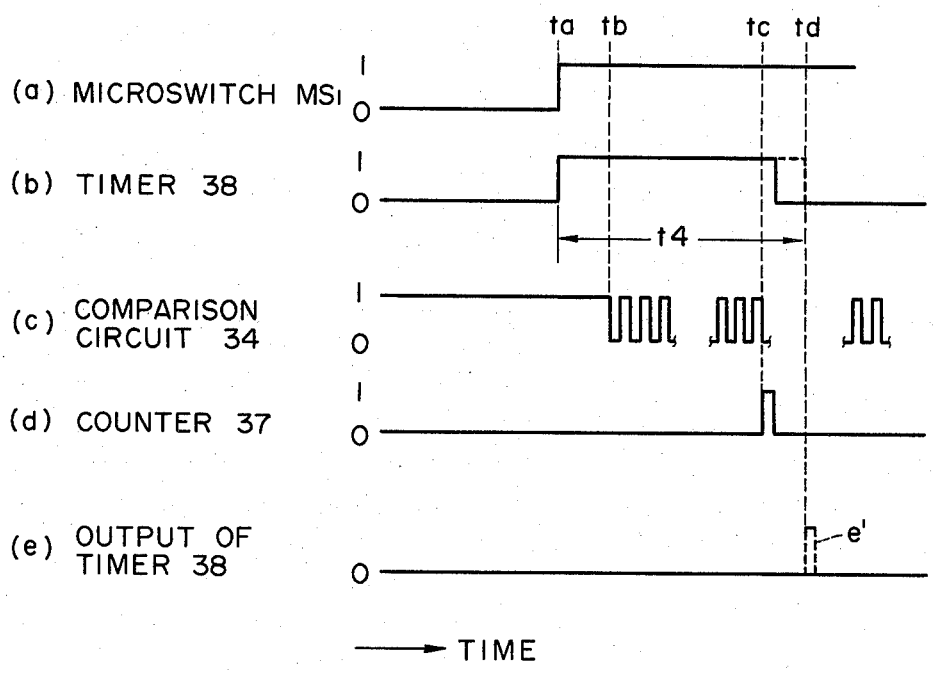
FIG. 5 is a timing chart.

Now the function of the above-described apparatus will be explained in the following in relation to the time chart shown in FIG. 5. In response to a start signal the motors M1, M2 and M4 are put into motion through the motor drive control circuit 39 to advance the microfilm F from the cartridge 8 through the determined path. Upon arrival of the leading end of the microfilm the microswitch MS1 is closed as shown by (*a*) in FIG. 5 to activate the timer 38 as shown by (*b*) in FIG. 5 and to also put the motor M3 into motion through said motor drive control circuit 39. On the other hand during the idle rotation of the winding shaft 16 the pulse generator 25 releases pulse signals which do not give rise to the release of count signals from the comparator circuit 34. Upon take-up of the film F on said winding shaft 16, the comparator circuit 34 initiates, as shown by (*c*) in FIG. 5, to release the count signals which are then counted by the counter 37. In case ten count signals are counted by the counter 37 within the functioning time t4 of said timer 38, there is released a reset signal at the time tc ((*d*) in FIG. 5) which resets the timer 38 so that no signal is obtained on the output line *c* thereof. Thus the absence of the output signal from said timer 38 indicates the correct advancement and normal take-up of the microfilm on the winding shaft 16.

Now there will be explained the case in which the normal advancement of the microfilm is hindered by eventual troubles such as jamming or breakage.

In case the film is jammed in the path therefor and does not reach the winding shaft 16 after the time ta, the winding shaft continues the high-speed rotation whereby the comparator circuit 34 does not release the count signals during the functioning time of the timer 38. Thus because of the absence of the reset signal from the counter 37, the timer releases, at time td, an output signal *e'* from the output terminal *c*, said signal indicating the presence of an abnormality in the film transportation and functioning to interrupt the motion of the motors M1, M2, M3 and M4 through the motor drive control circuit 39, thereby preventing the possible damage on the film. Also said signal *e'* may be utilized to inform the operator of the presence of an abnormality for example by lighting an alarm lamp or sounding a buzzer. Also in case of an eventual breakage of the film the motors are similarly stopped by the signal *e'* released from the timer 38.

As explained in the foregoing, the present invention allows rapid and secure detection of the abnormality in the film transportation resulting from film jamming, incorrect film take-up or film breakage, thereby preventing the damage on the film.

Figure 6:
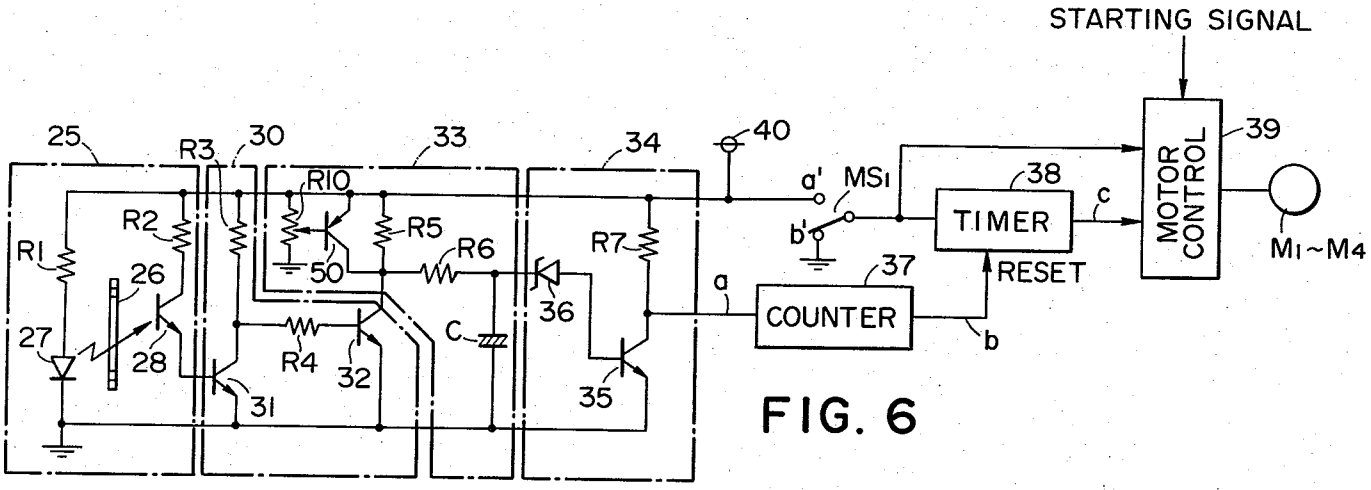
FIGS. 6 and 7 are circuit diagrams showing other embodiments of the detecting circuit.
Figure 7:
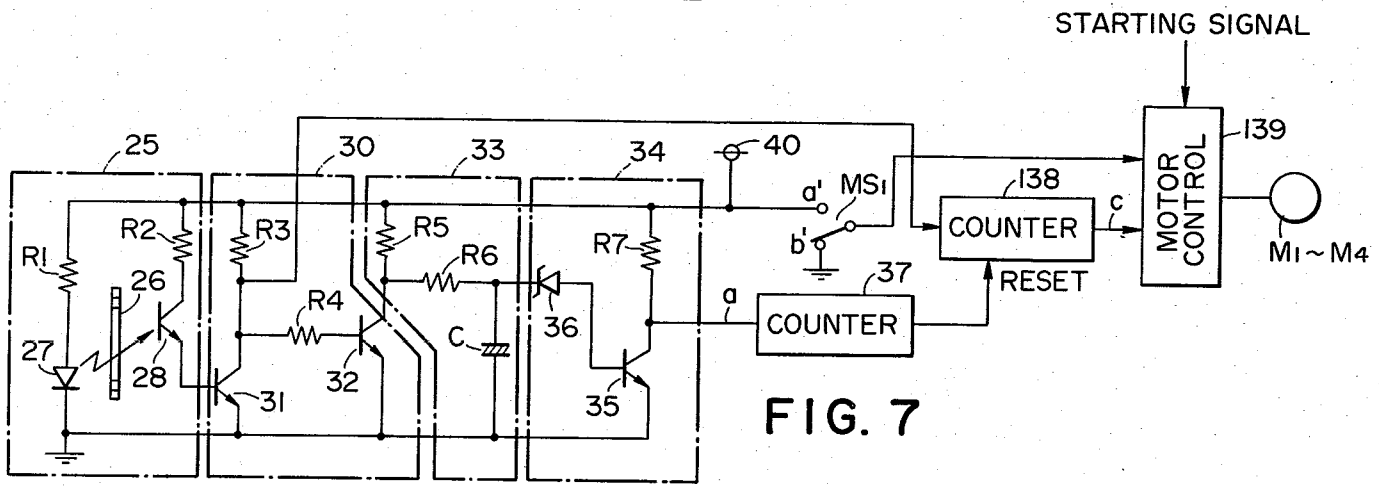

FIGS. 6 and 7 show other embodiments of the abnormality detecting circuit, wherein the components of the same functions as those represented in FIG. 4 are represented by same numbers. In FIG. 6 there are also shown a transistor 50 and a variable resistor R10 for modifying the time constant of the time constant circuit 33. The time constant of said time constant circuit 33 should naturally be modified in case the advancing speed of the film is modified, but such modification of the time constant is rendered possible in the circuit of FIG. 6 by adjusting the resistance of the variable resistor R10 in such a manner the time constant corresponds to the modified interval of the pulse signals to be generated by the pulse generator when the film is taken up on the winding shaft.

FIG. 7 shows an embodiment utilizing a counter in place of the timer 38, wherein there are shown a counter 138 for counting the pulse signal generated by the pulse generator 25, said counter to be reset by the output signal from the counter 37, and a motor drive control circuit 139 which is adapted to drive the motors M1, M2 and M4 in response to a start signal, to drive the motor M3 upon detection of the film by the microswitch MS1 and to stop said motors upon counting pulse signals of a determined number by the counter 138, said counter being structured to release a motor stop signal from an output line *c* upon counting pulse signals of a determined number slightly larger than the number of pulse signals to be counted from the start of the motor M4 to the output of reset signal from the counter 37 in normal take-up procedure of the film on the winding shaft 16.

What we claim is:

1. A web feeding apparatus comprising:
a drive source;
a take-up reel driven from said drive source;
means for feeding a web to said take-up reel along a predetermined path;
means for winding the web around said take-up reel;
pulse generating means for generating a pulse for each predetermined amount of angular rotation of said take-up reel;
timer means operable in response to arrival of the web at a predetermined position in said path;
signal generating means for intermittently generating signals at an interval when the interval of the pulses generated by said pulse generating means becomes longer than a predetermined pulse interval;
counting means for counting the signals generated from said signal generating means, said counting means putting out a signal for resetting said timer means when the number of the counted signals reaches a predetermined value; and
means for stopping said feeding means when said timer means, before the number of the counted signals reaches a predetermined value, operates for a set time period.

2. A web feeding apparatus according to claim 1, wherein said signal generating means include comparing means for comparing the interval of the pulses generated by said pulse generating means with a predetermined reference pulse interval which is longer than the interval of the pulses generated, by said pulse generating means, when the web is not wound around said take-up reel, said comparing means putting out a signal when the pulse interval becomes longer than said reference pulse interval.

3. A web feeding apparatus according to claim 2, wherein said comparing means include a time constant circuit operated by the pulses, and a circuit for putting out a signal when said time constant circuit operates for a set time period.

4. A web feeding apparatus according to claim 2, wherein said reference pulse interval is variable in accordance with the feeding speed of the web.

5. A web feeding apparatus according to claim 1, further comprising means for stopping said drive source when said timer means operates for a set time period, before the number of the counted signals reaches a predetermined value.

6. A web feeding apparatus comprising:
a drive source;
a take-up reel driven from said drive source;
means for feeding a web to said take-up reel along a predetermined path;
means for winding the web around said take-up reel;
pulse generating means for generating a pulse for each predetermined amount of angular rotation of said take-up reel;
measuring means operable in response to arrival of the web at a predetermined position in said path and measuring the amount of rotation of said take-up reel;
signal generating means for intermittently generating signals at an interval when the interval of the pulses generated by said pulse generating means becomes longer than a predetermined pulse interval;
counting means for counting the signals generated from said signal generating means, said counting means putting out a signal for resetting said measuring means when the number of the counted signals reaches a predetermined value; and
means for stopping said feeding means when, before the number of the counted signals reaches a predetermined value, the measured amount of rotation reaches a predetermined value.

7. A web feeding apparatus according to claim 6, wherein said signal generating means include comparing means for comparing the interval of the pulses generated by said pulse generating means with a predetermined reference pulse interval which is longer than the interval of the pulses generated, by said pulse generating means, when the web is not wound around said take-up reel, said comparing means putting out a signal when the pulse interval becomes longer than said reference pulse interval.

8. A web feeding apparatus according to claim 7, wherein said comparing means include a time constant circuit operated by the pulses, and a circuit for putting out a signal when said time constant circuit operates for a set time period.

9. A web feeding apparatus according to claim 7, wherein said reference pulse interval is variable in accordance with the feeding speed of the web.

10. A web feeding apparatus according to claim 6, further comprising means for stopping said drive source when the measured amount of rotation reaches a predetermined value, before the number of the counted signals reaches a predetermined value.

11. A web feeding apparatus according to claim 6, said measuring means includes counting means for counting the pulses generated by said pulse generating means, said counting means putting out a signal for stopping said feeding means when the number of the counted pulses reaches a predetermined value.

12. A web feeding apparatus comprising:

a drive source;

a take-up reel driven from said drive source;

means for feeding a web from a supply reel to said take-up reel;

means for winding the web around said take-up reel;

timer means to be operated in response to arrival of the web at a predetermined position in its feeding path, and putting out a signal after elapse of a set time period;

means for stopping said drive source and said feeding means in response to the signal from said timer means;

signal generating means for intermittently generating signals at an interval only when the web is wound around said take-up reel; and counting means for counting the signals generated from said signal generating means, said counting means putting out a signal for stopping said timer means when the number of the counted signals reaches a predetermined value.

* * * * *

UNITED STATES PATENT AND TRADEMARK OFFICE

CERTIFICATE OF CORRECTION

PATENT NO. : 4,291,843

DATED : September 29, 1981

INVENTOR(S) : HITOSHI YANAGAWA, ET AL.

It is certified that error appears in the above—identified patent and that said Letters Patent is hereby corrected as shown below:

Column 4, line 23, before "from" insert --count signals--.

Signed and Sealed this

Eighth Day of December 1981

[SEAL]

Attest:

GERALD J. MOSSINGHOFF

Attesting Officer

Commissioner of Patents and Trademarks